US005262006A

United States Patent [19]

Andersson et al.

[11] Patent Number: 5,262,006

[45] Date of Patent: Nov. 16, 1993

[54] PAPER MANUFACTURING PROCESS, AND PAPERS OBTAINABLE BY MEANS OF THAT PROCESS

[75] Inventors: Kjell R. Andersson; Per O. L. Östensson, both of Domsjö, Sweden; Stefan O. Kuni, Kotka, Finland

[73] Assignee: Mo Och Domsjo Aktibolag, Ornskoldsuik, Sweden

[21] Appl. No.: 741,528

[22] PCT Filed: Jan. 16, 1990

[86] PCT No.: PCT/SE90/00037

§ 371 Date: Aug. 12, 1991

§ 102(e) Date: Aug. 12, 1991

[87] PCT Pub. No.: WO90/09483

PCT Pub. Date: Aug. 23, 1990

[30] Foreign Application Priority Data

Feb. 13, 1989 [SE] Sweden ..... 8900475

[51] Int. Cl.[5] ..... D21H 11/14; D21H 17/70

[52] U.S. Cl. ..... 162/147; 162/181.2; 162/181.3; 162/183; 162/189; 162/191

[58] Field of Search ..... 162/135, 181.3, 183, 162/147, 189, 191, 181.2

[56] References Cited

U.S. PATENT DOCUMENTS 4,470,877 9/1984 Johnstone et al. ..... 162/181.3

4,853,085 8/1989 Johnstone et al. ..... 162/181.3

OTHER PUBLICATIONS

Eklund, D., "The Use of Gypsum in Pigment Coating", *Paperi ja Puu*, No. 9, pp. 558-570 (1976).

*Primary Examiner*—Peter Chin

*Attorney, Agent, or Firm*—Sughrue, Mion, Zinn, Macpeak & Seas

[57] ABSTRACT

Process in manufacturing paper wherein stock is prepared using cellulose fiber material which contains calcium sulfate (gypsum). said material being disintegrated in an aqueous medium in order to form part of the stock for the paper to be produced. The characterizing feature of the process is that (a) carbonate ions and/or hydrogen carbonate ions ($CO_3^{2-}$ or resp. $HCO_e^-$) are supplied to the aqueous medium, and (b) the pH in the aqueous medium is adjusted to an alkaline value so that calcium carbonate precipitates and forms part of the suspension.

There are overall major advantages provided by the process in the context of applying gypsum coatings on paper, inasmuch as broke can be reused in the process without any troublesome gypsum precipitation. Moreover a new grade of coated paper is described, the characterizing feature of this paper being that the filler of the base paper consists entirely or partly of precipitated calcium carbonate (PCC) and that the pigment of the coating layer consists entirely or partly of calcium sulfate.

26 Claims, No Drawings

PAPER MANUFACTURING PROCESS, AND PAPERS OBTAINABLE BY MEANS OF THAT PROCESS

TECHNICAL FIELD

This invention relates to reusing/recycling gypsum-containing cellulose fiber material in the manufacture of paper from a pulp stock of pH >6.5. The invention provides a technical solution so as to eliminate problems involved with the production of coated papers using gypsum pigments. It is applicable to the manufacture of coated and non-coated grades of paper, both wood-free and wood-containing, having a basis weight of 15 g/m$^2$ or more and also comprising paperboard products. The invention provides a possibility of manufacturing gypsum-coated papers which have excellent optical properties (brightness, whiteness, opacity, and light scattering coefficient).

The cellulose fiber materials used in this process are primarily recycled, broke, and/or waste paper. The content of gypsum in the cellulose material, calculated as $CaSO_4$ without water of crystallization, usually exceeds 0.5% (w/w) and may be for instance more than 1% or 2% (w/w). As a rule the gypsum content is less than 60% (w/w) although in some cases it may amount to up to 70% (w/w).

STATE OF ART

Within the field of papermaking systems, the reuse of cellulose fibers has been a time-honored classical expedient for minimizing the cost of raw materials. The procedure followed is to disintegrate either paper that has been used previously, in other words, paper, waste or paper that has been produced recently and been rejected as defective, that is broke paper, whereupon the resultant suspension is integrated into the stock employed for making the paper. The expression that "the suspension is integrated into the stock" means that its dry matter material wholly or partly forms the stock so as to totally or partially constitute the dry matter material of the stock "solids". Disintegration is normally performed in an aqueous medium Various procedures for processing broke and waste paper and problems inherent therein, have been described earlier in, for example, U.S. Pat. No. 3,865,684 and GB-A-9503. With respect to the reuse of gypsum-containing cellulose fiber materials, no good methods are available.

For a long time it has been known that gypsum may be used as a coating pigment in paper manufacturing techniques. See for example Eklund, D, Paperi ja Puu (1976) No. 9 pp. 559–70. Gypsum is a comparatively inexpensive material because it is obtained as a by-product in phosphate production processes and in systems for purifying $SO_2$-containing gases with lime.

For gypsum grades refined for paper manufacture see, for instance, EP-A-125,225, 125,224 and 112,317. It is believed that to obtain a high-quality coating on paper, a gypsum pigment may typically have a particle size of <10 microns preferably <3 microns. The best pigments in the market are recrystallized (re-precipitated) materials, and have an F content and a $P_2O_5$ content of <0.3%. Calcium carbonate may be present in small amounts as an impurity. For further information see, inter alia, EP-A-112,317.

Calcium carbonate ($CaCO_3$) is frequently used as a filler. In nature, it occurs in the form of, for instance chalk and calcite and, after being subjected to grinding, it has been used in paper making processes. However, the form of calcium carbonate with which the best results have been obtained has been a synthetically produced, precipitated calcium carbonate (PCC); this is obtained with a very homogeneous particle size distribution and in the form of uniform crystals. The usual way of producing PCC is either to react milk of lime with carbon dioxide or to react an aqueous solution of calcium chloride with sodium carbonate. In both of these processes, controlled and well-defined conditions are required in order to obtain a PCC of suitable physical properties. But PCC may be an expensive material as compared to other fillers; consequently such other fillers have often been chosen instead. For a survey see Gill, R. and Scot, W., Tappi Journal, Jan. 1987, pp. 93–99.

Problems involved with the reuse of gypsum-containing cellulose fiber material Papermakers hitherto have taken little interest in gypsum as a coating pigment. This is presumably due to the high water solubility of gypsum (2 g/l). In normal papermaking processes, some 10 to 40% of the production is usually rejected for reasons of quality and processing requirements, e.g. edge trimming. The rejected paper (broke) is disintegrated to form a 1–4% (w/w) solids suspension and is then reused in the process as fiber raw material. If this broke contains gypsum, a large portion thereof will be solubilized, because of the great solubility of gypsum - and, if worst comes to worst, this will give rise to a saturated solution of calcium sulfate. In view of the fact that the saturation concentration of calcium sulfate varies somewhat with temperature (maximum at about 40° C., $CaSO_4 . 2H_2O$), precipitates may be formed in process stages involving rapid changes in temperature, as e.g. in the press section and drying section of the paper machine. Such gypsum precipitates will form undesirable deposits on paper machine parts, thus causing poor runability of the paper machine. In those cases where the calcium sulfate saturation concentration is not reached, calcium ions will accumulate anyway to high concentrations in the process water.

It is known, also, that calcium ions ($Ca^{2+}$) are adsorbed on the cellulose fiber surface thus reducing the swelling capacity and strength of the fiber; that is, in cases where high contents of $Ca^{2+}$ are present the quality of the base paper produced will be deteriorated. A high concentration of $Ca^{2+}$ in the papermaking process may also have a negative effect on the paper chemicals added, such as hydrophobicizing agents and flocculants.

If latex binding agents are present in the coating composition another problem may arise as a consequence of using water-soluble pigments such as gypsum: The gypsum is dissolved during the disintegration of the broke, so what then remains is a free latex binder, so-called "white pitch", which has a tendency to adhere to parts of the paper machine.

The invention provides a solution to these problems.

The invention

The technical solution proposed according to the invention for the manufacture of paper, using gypsum-containing cellulose fiber materials, is characterized by the features that carbonate ions and/or hydrogen carbonate ions are added to the aqueous medium in which the cellulose material has been or will be disintegrated, and that the pH is adjusted to an alkaline value such that calcium carbonate is precipitated.

The thus resultant suspension is then passed on to the desired stock processing system where it may optionally be mixed with other cellulose pulps. In the stock processing system optional supplemental additives are added such as additional filler, retention aids, fluorescent whitening agents (i.e., optical brightening agents) etc. There may thus be one or more further steps intercalated between the precipitation of $CaCO_3$ and the step where the suspension obtained is incorporated into the stock. According to an alternative embodiment of the process, calcium carbonate precipitation is effected by means of dosing $CO_3^{2-}$, $HCO_3^-$ of $CO_2$ into the stock processing system. Finally the stock is spread onto a wire screen via the headbox of the paper machine; the paper is formed on the wire and drained, and then subjected to pressing and finally drying in the drying section of the machine, Thus in the paper as manufactured a precipitated calcium carbonate will be present as filler.

In the chemical literature it has very occasionally been reported that calcium sulfate is reacted with for instance sodium carbonate to commercially produce calcium carbonate.

$$CaSO_4 + Na_2CO_3 \rightarrow CaCO_3 + Na_2SO_4$$

The paucity of publications in this area is probably due to the circumstance that the reaction which takes place in the presence of solid $CaSO_4$ proceeds too slowly at high concentrations. It is quite surprising, therefore, that a practically complete carbonation of qypsum can be obtained from broke/recycled fibers under conditions that are normally prevalent when this broke is being disintegrated. It is also very surprising that the process results in a narrow particle size distribution of small calcium carbonate particles having a mean size below 10 microns, such as 0.3–5 microns, and in the form of homogeneous crystals. Due to this last-mentioned feature the resultant precipitated calcium carbonate (PCC) can be used as a substitute for commercial PCC of the highest grade, with the added advantage that the papermaker can readily produce this material in the normal processing system.

It appears that the present process results in the formation of substantially rhombohedral calcite (>50%). but presumably if different conditions are chosen other crystal forms are precipitated such as scalenohedral calcite. vaterite and aragonite.

It has also been observed that gypsum-coated paper is very easily disintegrated when the carbonation process is employed.

High-yield pulps such as are used in the manufacture of wood-containing coated papers are generally bleached without any addition of chlorine. The combination of PCC as the filler and gypsum as the coating pigment provides a way of producing an environmentally satisfactory paper, which has a much higher degree of brightness than the coated wood-containing papers manufactured by means of prior art techniques.

When bright and white wood-free coated papers are to be produced. i.e. papers from essentially chemical pulps, it is necessary, under current prior art techniques to use fluorescent whitening agents, such as derivatives of stilbenesulfonic acid triarine. But for some years now, the use of these optical whiteners has been called into doubt as a potential health harard; Italy, for instance prohibits the use of such whitening agents is entirely prohibited in all kinds of packaging materials for foods. e.g. coated cardboard materials for foodstuff packaging.

This combination of PCC as filler and gypsum as coating pigment provides the possibility of substantially increasing whiteness and brightness of the paper, thus the demand for using the aforesaid whitening agents can be reduced or entirely eliminated in/from the manufacture of these paper products. The said combination is particularly suitable for brightness degrees of >80% ISO.

Various embodiments of the invention are defined in greater detail below and are summarized in the attached claims, The carbonate ions/hydrogen carbonate ions used according to the invention may be added to the aqueous medium prior to, after, or together with the cellulose fiber material. What really matters is to make sure that gypsum carbonation proceeds until the desired stage is reached, such that 5–100%. e.g. more than 50%. with a preferred range of 80–100%. of the gypsum in the cellulose material has been converted to calcium carbonate. The degree of carbonation is calculable from the added amounts of gypsum and carbonate ion/hydrogen carbonate ion. The addition of carbonate ions/hydrogen carbonate ions to the aqueous medium may be performed in one of several different ways. According to one alternative a water-soluble metal carbonate salt or ammonium carbonate salt or the corresponding hydrogen carbonate is added in a dissolved or solid state. Another alternative procedure involves generating the ions in situ, for example by first adding a suitable soluble metal hydroxide and then supplying carbon dioxide. If carbonate generation with carbon dioxide is employed it is necessary to keep the pH under close control since carbon dioxide has the effect of lowering the pH so that there is a risk of the pH becoming too low for the carbonation process. A soluble hydrogen carbonate behaves in fundamentally the same manner as a carbonate but is a less efficient reagent because its aqueous solutions are less alkaline and, for that reason, have much lower contents of carbonate ions. This can be compensated for by the addition of bases of the type where the $pK_a$ of the corresponding acid is higher than or approximately equal to the $pK_a$ of $HCO_3^-$, for example hydroxide ions.

Provided the pH is properly adjusted the same results may be obtained according to the invention using either soluble carbonate salt, soluble hydrogen carbonate salt or generating the carbonate in situ. These variant forms of the invention should therefore be regarded as being equivalent, The terms water-soluble carbonate salt, and water-soluble hydrogen carbonate salt are to be construed in the sense that the solubility properties of these salts are such that if an aqueous solution of such a salt has an stoichiometric (equivalent) amount of gypsum added to it then this will cause calcium carbonate to be precipitated. In the normal case this means that the carbonate/-hydrogen carbonate salts in question have a solubility (mol/lit.) exceeding that of calcium carbonate by a power of 10 as measured at the process temperature for the $CaCO_3$ precipitation. Examples of salts fulfilling these characteristics are alkali metal and ammonium carbonates, and the corresponding hydrogen carbonates.

The amount of carbonate salt to be added is calculated on the basis of the amount of added cellulose fiber material and the gypsum content thereof Expressed as a percent of the stoichiometric amount for carbonation of the gypsum content of the added cellulose fiber material, the dose of soluble carbonate to be added should be within the range of 5-300%, the preferred range being about 80-200%. Both in the case of carbonate and in the case of hydrogen carbonate it is an important requirement that the pH be maintained within an optimum range for $CaCO_3$ precipitation, this being $>(pK_{HCO3^-}$ minus 3), preferable minus $>(pK_{HCO3^-}$ minus 2). At 25° C., values correspond to pH $>7.3>8.3$ respectively. A preferred upper limit is $pH=(pK_{HCO3^-}$ plus 4), that is, pH $=14.3$ at 25° C. In case the pH is to lie outside these ranges at some point in time its readjustment is effected with acid or base, with the compensatory expedient of running the process for a longer time. If the pH goes down to below $pH=pK_a$ of $H_2CO_3$ this will result in carbon dioxide evolution, to the effect that carbonate is removed. This may be compensated for by means of adding more $CO_3^{2-}/HCO_3^-$. The term $pK_{HCO3^-}$ refers to values measured at the processing temperature for the precipitation of $CaCO_3$. If conditions become too alkaline this may be deleterious to the cellulose fiber (yellowing).

Conversion of the gypsum content of the cellulose fiber material to calcium carbonate may be performed within a wide range of temperatures, of from 5° to 100° C. The preferred range is 10°-70° C. Reaction times may vary from about one minute to a couple of hours.

The most practical application of the process according to the invention involves continuously dosing the qypsum containing cellulose fiber material, the water-soluble carbonate/hydrogen carbonate, and optional pH-adjusting chemicals into a disintegrator containing the aqueous medium. The process can be controlled by continuous measurement of the dissolved $Ca^{2+}$ and the pH in the aqueous medium (i.e. in the disintegrator tank); if the pH rises after an optimum pH has been set this will indicate that there is an excess of soluble carbonate, whereas an increasing $Ca^{2+}$ concentration and decreasing pH indicate that the added amount of soluble carbonate (including hydrogen carbonate) has been insufficient. Thus if there is a rise in the pH one will proceed by decreasing the amount of soluble carbonate added, or alternatively increasing the added amount of gypsum-containing cellulose fiber material; when the $Ca^{2+}$ concentration increases or the pH becomes lower than the optimum value that had been set one will proceed by decreasing the added amount of cellulose fiber material or alternatively increasing the added amount of soluble carbonate.

The optical properties of paper produced according to the invention appear to depend on the repulping conditions.

In our laboratory experiments, it seems that the best optical properties of the paper are obtained if the carbonate/hydrogen carbonate ions are dosed continuously or in small portions during the repulping of the gypsum containing broke.

The process of the invention gives a readily soluble sulfate as a by-product. e.g. sodium sulfate. In contrast to calcium sulfate these other sulfates are rather harmless entities in the papermaking process. It is however possible to reduce the amount thereof in the resultant pulp suspension, if necessary; vir., by means of filtration, ultrafiltration, reverse osmosis etc. The salt-rich water separated may then be passed on to the ordinary effluent treatment system of the paper mill.

According to one embodiment of the invention the paper produced the base paper is coated with a coating colour preferably containing gypsum as its pigment component. Known grades of gypsum for coating purposes may be employed, as well as future grades. The composition of the coating colour is such as is common practice in this field - the coating colour containing in addition to pigment optionally also the following components; water, binder e.g. latex binder, starch, carboxymethyl cellulose and additives such as wet strength agents, fluorescent whitening agents, slimicides, and so forth. Latex binders are aqueous dispersions of small particles of a water-insoluble polymer. These polymer particles which may consist of styrene butadiene rubber, polyacrylate, polyvinyl acetate etc. typically have a relatively low glass transition temperature (<50° C.). The dry solids content of the coating colour is within the ordinary range as usually employed within this technical field, id est 5-80% (w/w), with the gypsum being 10-100% thereof. Binder forms part of the solids content and is normally set forth with reference to the total amount of pigment. The normal content of binder calculated in this manner is 5-20% (w/w). The amount of coating applied is such as is normal in the present field of technology, i.e. 4-30 g/m$^2$ of the solids content of the coating colour. This embodiment of the invention is very practical, since paper broke formed in the process can be reused directly in the base paper manufacture. This embodiment comprises monolayer coating and multilayer coating, and coating on either one side or both sides of the paper. In each individual layer a different coating colour composition may be used.

On the filing date, the most preferred embodiment of the invention comprised precipitation of $CaCO_3$ with an alkali metal carbonate at 10°-70° C. said alkali metal carbonate (preferably $Na_2CO_3$) being employed in an equivalent amount (±20%) relative to the gypsum, or in excess thereof. An embodiment equally preferred uses the same dosage of the corresponding hydrogen carbonate, and generation of carbonate in situ. An optimum pH here is the same as aforesaid.

One embodiment of the invention comprises a coated paper which contains filler in the base paper and contains pigment in a coating layer. The characteristic feature here is that the filler is partly cr entirely a precipitated calcium carbonate (PCC). preferably 0.5-50% (w/w) of the weight of the paper, and that the pigment consists entirely or partly of gypsum. The lower range of PCC contents (0.5-10% w/w) may apply to liner and paperboard products. For other paper products the PCC content amounts to 2-50% (w/w). in some cases down to as far as 0.5% (w/w) of the weight of the paper. Fluorescent whitening agents content may be lower than those commonly employed and may for example amount to <0.2% (w/w). Gypsum as a coating pigment may be incorporated in amounts such as are ordinary with conventional techniques; cp. above.

According to a preferred embodiment 5-100% (w/w) of the filler in the base paper (e.g. 5-50% w/w or 50-100% w/w) consists of precipitated calcium carbonate (PCC). and 5-100% (w/w) of the pigment in the coating layer (e.g. more than 50% w/w like for instance more that 90% w/w or about 100% w/w) consist of gypsum. The remaining ingredients may be other chemicals such as are commonly employed in papermaking processes (see above). The gypsum percentages and PCC percentages as set forth are calculated as percentages of the total content of mineral pigment and mineral filler respectively.

The paper according to the invention may contain more than one filler. Thus it is possible to have clay, ground calcium carbonate, titanium dioxide etc. present therein together with the PCC. The paper also may contain a plurality of different coating pigments; these pigments being applied either as an admixture with one another or each in a separate layer.

The various types of paper according to the invention comprise different grades of coated paper such as coated fine paper, LWC and MWC grades, and coated paperboard, folding box board and liner.

As will be appreciated from the above information, one was of producing the paper according to the invention is that set forth in the attached claims. It is also possible to produce the paper according to the invention by starting from paper having a PCC filler and coating it with a gypsum-containing coating colour. If broke from the process is recycled, a carbonation of gypsum according to the above description will provide substantial advantages in this case, both practical and economical.

By using the inventive concept of employing recycled broke as a gypsum-containing cellulose material for the manufacture of gypsum-coated paper the base paper is supplied with PCC as a filler. If the recycled broke comprises 5–40% of the total fiber raw material the PCC thus supplied to the base paper will as a rule amount to 5–60% (w/w) of the filler in the paper produced. Depending on the amount of filler in the base paper and on the proportion of broke therein the proportional amount of CC formed in the process may rise considerably higher (60–100% w/w).

Moreover it has been shown by means of electron microscopic studies that the method of this invention offers the possibility to carbonate gypsum directly without being dissolved out of the binder of the coating layer. A new matrix is formed by PCC and binder. In cases where the coating layer contains latex binder and the coated paper is reused, this means that there is little tendency for the latex binder to be released in the form of "white pitch".

Because the process of the invention may result in a new matrix of PCC and the latex binder, a paper manufactured in accordance with the process of the invention may contain latex binder of the aforesaid type, for example in the form of such a matrix bound PCC in proportions as mentioned above.

The invention will now be illustrated by way of a number of examples which are non-limitative.

EXAMPLE 1

A base paper produced on a commercial paper machine, basis weight 76 g/m$^2$, filler 17% (ground chalk), which had been given a surface siring of oxidized starch containing fluorescent whitening agent (about 0.2% w/w on a dry paper basis. Blankophor P from Bayer, Germany). and which had been produced from fully bleached chemical pulps (sulfate pine: sulfate birch =40:60) was coated by means of a laboratory coater (Dixon. Model No. 160 MK 11/B) with a coating colour containing 59.7% solids; the composition of this coating colour being 100 parts of gypsum [PCS-91,(=reprecipitated, recrystallized) gypsum from Boliden Kemi, Sweden], 10 parts of latex binder (Dow 685. Dow Chemical Europe. Switzerland) and 1 part of carboxymethyl cellulose (CMC 7ELCl, Hercules Inc., USA). The coating colour was applied by way of a two-step procedure to thus produce a total coating weight of 55 g/m$^2$ dry coating layer on one side of the base paper, Then pulp suspensions with 3% solids contents were produced from the gypsum-coated paper, both (i) in a conventional manner and (ii) in a manner according to the present invention. 60 g of paper were introduced into 2 liters of water in a disintegrator where the paper was then repulped for 15 minutes at 23° C. In the experiments representing tests of the invention 0.037 g, 0.074 g, 0.148 g and 0.233 g of $Na_2CO_3$ ($Na_2CO_3$. 10 $H_2O$. Riedel-de Haen AG, Germany) per g of coated paper were added to the water immediately before addition of the paper.

After the disintegration of the coated paper a minor portion of each pulp suspension was set aside to be assayed, by means of atomic absorption, to determine the concentration of dissolved $Ca^{2+}$.

Then 233 9 of the pulp suspensions were diluted to 1 liter, the concentration thus becoming 0.7%. Of this suspension 414 g were charged into a Finnish sheet former (F 101) for handsheet production. After having been dewatered on the wire the sheets were subjected to pressing at 3.55 kg/cm$^2$ pressure, whereupon they were dried at 23° C. and RH 50% for 24 hours. Basis weights and filler contents of the resultant sheets were determined (incineration in a furnace at 500° C.). The optical properties brightness (ISO%), opacity and light scattering coefficient (557 nm) were also determined, with an Elrepho 2000. It should be mentioned also that these measurements were made in accordance with SCAN-P:75R, SCAN-P 8:75R and SCAN-C 27R-76.

The results obtained are set forth in Table 1.

TABLE 1

| | Conv. paper sheet | Paper sheets produced acc. to the invention | | | |
|---|---|---|---|---|---|
| | A | B | C | D | E |
| $Na_2CO_3$ (g/g coated paper) | 0 | 0.037 | 0.074 | 0.148 | 0.233 |
| Basis weight (g/m$^2$) | 67.7 | 71.2 | 70.6 | 70.2 | 68.3 |
| Dissolved $Ca^{2+}$ in pulp susp. (mg/l) | 584 | 525 | 465 | 404 | 8 |
| Filler (%) | 25.7 | 29.3 | 27.6 | 28.8 | 31.9 |
| Brightness, ISO % | 81.3 | 82.6 | 83.0 | 84.0 | 84.1 |
| Opacity % | 86.1 | 88.3 | 89.4 | 90.4 | 89.5 |
| Light scattering coeff. (m$^2$/kg) | 41.8 | 47.0 | 51.1 | 56.9 | 55.7 |

The results obtained show unambiguously that the process of the invention has highly positive effects on the optical properties of the paper sheets. Note also that the filler content of the sheets is significantly higher and that the content of dissolved $Ca^{2+}$ has decreased dramatically in the pulp suspension due to the treatment with sodium carbonate.

In the manufacturing procedure of sheet E in Table 1, approximately a stoichiometrical amount of sodium carbonate has been added to the gypsum in the disintegrated coated paper. The filler in this sheet was studied by means of scanning electron microscope (SEM) and compared with a sheet that had been produced in a conventional manner.

The images obtained showed (1) that in the untreated sheet the filler contained gypsum particles of varying shapes and sizes and (2) that the paper sheet manufactured according to the invention contained large amounts of precipitated calcium carbonate in the form of rhombohedral calcite, with a very narrow particle size distribution (about 1 micron).

Energy dispersive X-ray analysis of a sheet produced according to the invention and a sheet produced in a conventional manner has shown (1) that the sheet produced in the conventional manner has a high content of sulfur (from $CaSO_4$), and (2) that the sheet produced according to the invention is substantially sulfur-free. i.e. due to the carbonate treatment the gypsum from the coated paper has reacted to form calcium carbonate.

EXAMPLE 2

In these tests, the same base paper was coated with the same coating colour as in Example 1. The coating operation was carried out in one step by means of the laboratory coater; the total amount applied was 23.5 g/m² dry coating layer on the base paper. Pulp suspensions were prepared in a way similar to that described in the preceding example, but this time the following water-soluble carbonates were tested: 0.17 g potassium carbonate (E. Merck AG, Germany) and 0.10 9 sodium hydrogen carbonate (E. Merck AG) per gram of coated paper. Additions of the carbonates were made in the same way as before. This series of experiments also comprised a supplemental experiment with sodium hydrogen carbonate, with 1.2 ml of 1 M NaOH solution per gram of coated paper being added to the water prior to the addition of hydrogen carbonate. The intention here was to demonstrate that a certain degree of alkalinity is required in the system for obtaining the full effect of the sodium hydrogen carbonate.

The concentration of dissolved $Ca^{2+}$ was determined in the pulp suspensions. Sheets of paper were manufactured in the same manner as described before. In the case of the experiments with sodium hydrogen carbonate, the pH was determined immediately before and after disintegration of the coated paper. The paper sheets produced were then analyzed with respect to their basis weight, filler content and optical properties in the same manner as in the preceding example. The results obtained from these experiments are set forth in Table 2.

TABLE 2

| | Conv. paper sheet | Paper sheets produced acc. to the invention | | |
|---|---|---|---|---|
| | A | B | C | D |
| $K_2CO_3$ (g/g coated paper) | 0 | 0.17 | 0 | 0 |
| $NaHCO_3$ (g/g coated paper) | 0 | 0 | 0.10 | 0.10 |
| 1M NaOH (ml/g coated paper) | 0 | 0 | 0 | 1.2 |
| pH before defibr. | 5.8 | — | 8.1 | 11.1 |
| pH after defibr. | 6.3 | — | 7.6 | 8.7 |
| Dissolved $Ca^{2+}$ in pulp susp. (mg/l) | 592 | 18 | 418 | 104 |
| Basis weight (g/m²) | 73.7 | 76.1 | 74.1 | 76.2 |
| Filler (%) | 16.3 | 19.9 | 15.6 | 20.0 |
| Brightness, ISO % | 82.1 | 85.7 | 83.1 | 85.8 |
| Opacity % | 88.1 | 89.5 | 87.7 | 89.7 |
| Light scattering coeff. (m²/kg) | 44.0 | 53.1 | 44.6 | 53.9 |

These results show that very good effects have been obtained both with potassium carbonate and with sodium hydrogen carbonate. In the latter case, however, some alkali has to be added for attaining a fully satisfactory effect.

EXAMPLE 3

These experiments were directed to evaluating the effect of added ammonium carbonate (J. T. Baker Chemicals BV. Holland) in repulped gypsum-coated paper. The coated paper carried a total of 6.5 g/m² dry coating layer on one of its sides. As for the rest the base paper, coating colour, disintegration and paper sheet production were the same as in Example 1. Dissolved $Ca^{2+}$ concentration, bass weight, filler content and optical properties were determined in the sheets in the same manner as in the foregoing examples. Table 3 sets forth the results obtained in these tests.

TABLE 3

| | Conventional paper sheets | Paper sheets produced acc. to the invention |
|---|---|---|
| $(NH_4)_2CO_3$ (g/g coated paper) | 0 | 0.04 |
| Dissolved $Ca^{2+}$ in susp. (mg/l) | 496 | 261 |
| Basis weight (g/m²) | 91.6 | 89.5 |
| Filler (%) | 18.6 | 20.3 |
| Brightness, ISO % | 83.5 | 83.7 |
| Opacity % | 90.9 | 91.3 |
| Light scattering coeff. (m²/kg) | 44.7 | 47.3 |

This experiments shows that significant positive effects are obtainable with small amounts of added ammonium carbonate.

EXAMPLE 4

The gypsum-coated paper described in Example 1 was repulped in a conventional manner so as to form a 3% pulp suspension. This was mixed with a bleached pine sulfate pulp (2.3%) beaten to 24° SR, as follows:

Stock (a) 0.3 parts by weight of gypsum paper suspension (dry basis) +0.7 parts by weight of pine sulfate pulp (dry basis).

Stock (b) 0.3 parts by weight of gypsum paper suspension (dry basis) +0.7 parts by weight of pine sulfate pulp (dry basis) containing 0.155 g of $Na_2CO_3$/g pulp (dry basis).

In case (b) the sodium carbonate was added to the pine sulfate pulp before the incorporation of the gypsum paper suspension.

The paper stocks thus obtained were left to stand, with agitation, for about 15 minutes. Then sheets of paper were manufactured as described in Example 1. Basis weight, filler content, brightness (ISO%), opacity and light scattering coefficient of the paper sheets obtained were determined in accordance with methods as described earlier.

The results of these tests will appear from Table 4.

TABLE 4

| | Paper sheets from stock (a) | Paper sheets from from stock (b) (acc. to the inv.) |
|---|---|---|
| Basis weight | 96.8 | 99.3 |
| Filler (%) | 4.2 | 6.2 |
| Brightness, ISO % | 81.6 | 82.8 |
| Opacity % | 84.0 | 86.4 |
| Light scattering coeff. m²/kg | 31.1 | 36.0 |

These results show that good effects are obtainable also if carbonation is carried out after the broke from the gypsum-coated paper has been mixed with other stock-components.

EXAMPLE 5

In this example coating tests were performed on paper sheets A and E which had been produced in accordance with the process described in Example 1, Sheet A produced in a conventional manner and sheet E treated with 0.233 g of $Na_2CO_3$/g of paper—so that precipitated calcium carbonate (PCC) was formed and constituted part of the filler content of the sheet—were coated manually with two different coating colours, the coating operation being performed with a manual blade applicator One of the two coating colours was identical with the gypsum formulation described in Example 1 whereas the other coating colour was a conventional clay/chalk formulation which contained 60% solids having the following composition: 70 parts clay (SPS, ECC. England). 30 parts chalk (Hydrocarb 90 M. Omya. Germany). 10 parts latex binder (Dow 6B5. Dow Chemical Europe. Switzerland), 1 part carboxymethyl cellulose (CMC 7ELCl, Hercules Inc., USA), and 0.25 part dispersing agent (Polysalz, BASF AG Germany).

Application of each coating colour (12–13 g of colour [calculated as solids] per $m^2$ of paper) was effected by means of a single coating operation on one side of each of sheets A and E. The sheets were dried for two minutes at 105° C. whereupon the optical properties were determined. viz. brightness (ISO%), whiteness CIE (W), light scattering coefficient (at 557 nm) and opacity (at basis weight 80 g/$m^2$); these determinations being made with an Elrepho 2000 and in conformite with the SCAN methods as set forth in Example 1. Whiteness CIE (W) is a European standard which is correlated with whiteness as experienced by the human eye. Table 5 sets forth the results obtained.

TABLE 5

| Base paper | Sheet A (without PCC) | | Sheet E (with PCC) | |
|---|---|---|---|---|
| Coating pigment | Clay/chalk | Gypsum | Clay/chalk | Gypsum |
| Brightness, ISO % | 82.8 | 84.5 | 84.4 | 86.1 |
| Whiteness, (CIE, W) | 81.2 | 89.0 | 82.6 | 94.6 |
| Light scattering coeff. ($m^2$/kg) | 66.0 | 66.6 | 77.2 | 77.9 |
| Opacity %, (80 g/$m^2$) | 94.1 | 92.3 | 94.9 | 94.8 |

These results show that a coated paper with the combination of PCC as a base paper filler and gypsum as coating pigment will have much better optical properties than will coated papers manufactured with other combinations of filler +pigment in their base papers and coating layers respectively.

Base sheets A and E in this example contain fluorescent whitening agent from the machine-produced paper broke (see Example 1). Although fluorescent whitener does have an effect on the whiteness of the paper, it should be noted that the supplemental effect on whiteness as obtained by means of the PCC +the gypsum combination in our tests is extraordinarily great; that is, it appears that a synergism effect is obtained from the PCC filler and the gypsum pigment. This example shows that when the combination PCC +gypsum is employed, the papermaking process can be performed with lesser or zero amounts of fluorescent whitening agent,

EXAMPLE 6

In this example, coating experiments were carrie out on two base papers (fine papers) having a basis weight of about 70 g/$m^2$ and produced as follows:

(a) This base paper was manufactured on an experimental paper machine (width 220 mm, speed 1–2 m/min). The pulp composition was 40/60 fully bleached pine sulfate/birch sulfate, and the filler used was a chalk (DX 50, Omya, Germany). The filler content was 15.3%, and the paper was given a surface siring of oxidized potato starch (about 1.5% on a dry paper basis). Other additives such as retention aids, stock hydrophobicizing agents and cationic starch were of ordinary types such as are commonly used in the art of manufacturing fine paper.

(b) This base paper was produced with a precipitated calcium carbonate of the scalenohedral calcite type (Albacar HO, Pfizer Inc., USA). The filler content in this case amounted to 16.2%; as for the rest, conditions in the manufacturing procedure were the same as in A.

The two base papers A and B were blade-coated manually on one side with the gypsum formulation described in Example 1 (the amount applied being 12 g/$m^2$).

Optical properties were determined as in the preceding examples, on (i) the uncoated base papers and (ii) the papers that had been coated. Results of these measurements are listed in Table 6.

TABLE 6

| | Base sheet | | Gypsum coated paper | |
|---|---|---|---|---|
| | A (chalk) | B (PCC) | A (chalk) | B (PCC) |
| Brightness, ISO % | 83.2 | 89.1 | 87.4 | 90.4 |
| Whiteness, CIE, W | 70.7 | 79.6 | 80.8 | 84.1 |
| Light scattering coeff. ($m^2$/kg) | 43.7 | 62.7 | 60.5 | 73.7 |
| Opacity % | 83.5 | 87.0 | 90.6 | 91.1 |

Similarly to what was shown in Example 5, the results here again show that PCC as filler and gypsum as coating pigment will give paper grades having particularly good optical properties. Note that in the experiments of the present example—contrary to those of Ex. 5—the papers do not contain any fluorescent whitening agent. Despite this fact the combination of PCC +gypsum produces a grade of paper with high degrees of brightness and whiteness. The use of this combination therefore may constitute a future method for the manufacture of paper and paperboard grades intended for use in contact with foodstuffs.

EXAMPLE 7

Coating experiments in this example were carried out on wood-containing base paper having a basis weight of 49 g/$m^2$.

The base paper was manufactured with a pulp composition of 50/50 groundwood pulp/fully bleached pine sulfate. The groundwood pulp (Bure 80 EF from Bure träsliperi, Sweden) had a refining degree of 80 CSF.

Paper was produced with 11.3% PCC of the same type as in Example 6, on the experimental paper machine and under conditions similar to those described in the preceding example, but without any surface sizing.

Next, the wood-containing base paper was given a coating of the gypsum formulation described in Example 1, this coating being applied manually by means of a blade applicator (about 10.5 g of coating colour, dry basis, per $m^2$ applied on one side of the paper).

The optical properties mentioned above were determined; for results see Table 7.

TABLE 7

| | |
|---|---|
| Brightness, % ISO | 85.8 |
| Whiteness CIE, W | 71.4 |
| Light scattering coeff. ($m^2/kg$) | 83.9 |
| Opacity (%) | 90.0 |

These results show that it is possible to obtain good optical properties also on wood-containing coated paper, when PCC is used as filler and gypsum as coating pigment. This paper according to the invention has much higher degrees of brightness and whiteness than wood-containing coated papers that have been produced in a conventional manner; an example of such conventional paper grades being commercial LWC paper which will normally have a brightness value of between 70 and 75%ISO.

What is claimed is:

1. A process for the manufacture of paper, comprising:

(a) preparing pulp stock having a pH greater than 6.5 entirely or partly comprising cellulose fiber material containing 0.5 to 70% (w/w) of calcium sulfate, wherein the cellulose fiber material is selected from the group consisting of broke and waste paper;

(b) forming a suspension in an aqueous medium with the stock;

(c) supplying at least one of carbonate ions and hydrogen carbonate ions to the aqueous medium;

(d) adjusting the pH of the aqueous medium to an alkaline value within a pH range of greater than 7.3 to 14.3 at a temperature of 25° C. to precipitate calcium carbonate so that the calcium carbonate forms part of the suspension;

(e) spreading the suspension onto a wire screen;

(f) forming paper on the wire screen; and (g) draining, pressing and drying the paper.

2. The process for the manufacture of paper according to claim 1, further comprising mixing the suspension formed in step (b) with other cellulose pulps.

3. The process for the manufacture of paper according to claim 1, wherein the precipitated calcium carbonate is in the form of particles having a mean size less than 10 microns.

4. The process for the manufacture of paper according to claim 3, wherein the means size is 0.3 to 5 microns.

5. The process for the manufacture of paper according to claim 1, wherein the precipitated calcium carbonate comprises rhombohedral calcite.

6. The process for the manufacture of paper according to claim 1, wherein the precipitated calcium carbonate is in a crystal formation selected from the group consisting of scalenohedral calcite, vaterite and aragonite.

7. The process for the manufacture of paper according to claim 1, wherein the amount of calcium sulfate converted to calcium carbonate is 5–100%.

8. The process for the manufacture of paper according to claim 7, wherein the amount converted is more than 50%.

9. The process for the manufacture of paper according to claim 7, wherein the amount converted is 80–100%.

10. The process for the manufacture of paper according to claim 1, wherein step (c) comprises adding a water-soluble carbonate salt or water-soluble hydrogen carbonate salt in a dissolved or solid state.

11. The process for the manufacture of paper according to claim 10, wherein the water-soluble carbonate salt or the water-soluble hydrogen carbonate salt is selected from the group consisting of alkali metal and ammonium carbonates.

12. The process for the manufacture of paper according to claim 1, wherein step (c) comprises generating the ions in situ by first adding a soluble metal hydroxide and then supplying carbon dioxide.

13. The process for the manufacture of paper according to claim 10, wherein the amount of the water-soluble carbonate salt or the water-soluble hydrogen carbonate salt added is calculated based on the amount of cellulose fiber material.

14. The process for the manufacture of paper according to claim 13, wherein the amount added is 5–300% of the stoichiometric amount for forming calcium carbonate from the calcium sulfate.

15. The process for the manufacture of paper according to claim 13, wherein the amount added is 80–200% of the stoichiometric amount for forming calcium carbonate from the calcium sulfate.

16. The process for the manufacture of paper according to claim 1, wherein the pH is adjusted, at a temperature of 25° C. within the range of greater than 8.3 to 14.3.

17. The process for the manufacture of paper according to claim 1, wherein the precipitation of calcium carbonate occurs at a temperature ranging from 5° C. to 100° C.

18. The process for the manufacture of paper according to claim 17, wherein the temperature ranges from 10° C. to 70° C.

19. The process for the manufacture of paper according to claim 1, wherein the at least one of carbonate ions and hydrogen carbonate ions is supplied by continuous dosing.

20. The process for the manufacture of paper according to claim 1, wherein the pH is adjusted by adjusting the amount of the at least one of carbonate ions and hydrogen carbonate ions or the amount of cellulose fiber material added.

21. The process for the manufacture of paper according to claim 1, further comprising coating the paper produced with a coating color containing gypsum.

22. The process for the manufacture of paper according to claim 1, wherein the calcium carbonate is precipitated with an alkali metal carbonate at 10°–70° C. in an amount equal to or greater than the amount of the calcium sulfate.

23. The process for the manufacture of paper according to claim 1, wherein calcium carbonate is precipitated using hydrogen carbonate and generating carbonate in situ.

24. The process for the manufacture of paper according to claim 1, wherein the cellulose fiber material is paper comprising gypsum as the coating pigment.

25. The process for the manufacture of paper according to claim 1, wherein the cellulose fiber material is broke paper which contains gypsum.

26. The process for the manufacture of paper according to claim 1, wherein the cellulose fiber material is waste paper which contains gypsum.

* * * * *